US005392610A

United States Patent [19]

Nelson et al.

[11] Patent Number: 5,392,610

[45] Date of Patent: Feb. 28, 1995

[54] METHOD AND APPARATUS FOR RECOVERING REFRIGERANTS FROM HOME REFRIGERATION SYSTEMS

[75] Inventors: John A. Nelson, Benton Township, Berrien County; David B. Kirby; Phalguni S. Roy, both of St. Joseph Township, Berrien County; John L. Wuepper; Nihat O. Cur, both of Royalton Township, Berrien County, all of Mich.; Allen C. Schmaltz, Scipio Township, LaPorte County; John L. Deaner, Coolspring Township, LaPorte County, both of Ind.; Terry L. McGath, Kettering, Ohio

[73] Assignee: Whirlpool Corporation, Benton Harbor, Mich.

[21] Appl. No.: 161,334

[22] Filed: Dec. 2, 1993

Related U.S. Application Data

[63] Continuation of Ser. No. 661,463, Feb. 26, 1991, Pat. No. 5,293,756, which is a continuation-in-part of Ser. No. 413,823, Sep. 28, 1989, Pat. No. 4,996,848.

[51] Int. Cl.[6] ..... F25B 45/00

[52] U.S. Cl. ..... 62/77; 62/292; 141/10

[58] Field of Search ..... 62/77, 149, 292; 53/79, 53/403, 431, 434, 512; 141/10, 65, 114; 383/3, 96, 904, 906

[56] References Cited

U.S. PATENT DOCUMENTS

| | | | |
|---|---|---|---|
| 2,764,859 | 10/1956 | Hanselmann | 53/22 |
| 3,232,070 | 2/1966 | Sparano | 62/149 |
| 3,892,058 | 7/1975 | Komatsu et al. | 53/21 FC |
| 4,261,178 | 4/1981 | Cain | 62/149 |
| 4,331,001 | 5/1982 | Jones | 62/503 |
| 4,363,222 | 12/1982 | Cain | 62/292 |
| 4,364,236 | 12/1982 | Lower et al. | 62/77 |
| 4,441,330 | 4/1984 | Lower et al. | 62/149 |
| 4,476,688 | 10/1984 | Goddard | 62/149 |
| 4,513,578 | 4/1985 | Proctor et al. | 62/149 |
| 4,756,349 | 7/1988 | Atkins | 141/114 X |
| 4,768,347 | 9/1988 | Manz et al. | 62/149 |
| 4,776,174 | 10/1988 | Rich et al. | 62/77 |
| 5,058,631 | 10/1991 | Grant | 141/10 |

OTHER PUBLICATIONS

Robert Bosch Hausgerate GmbH Publication No. ZKD 51 4161 6902-003 M (including English translation).
Linde AG Publication No. 85502-0987-3.10PE).
Distriparts Sweden AB Publication No. 599 25 04-19/4.
Bauknecht brochure and related Bauknecht press information publications (including English translation).
Nutech Corporation brochure, Printed Jan. 1982 Pollution Measurements Corporation brochure (undated).
Official Gazette, Aug. 30, 1988, publication of U.S. Pat. No. 4,766,733.
Robinar publication No. SA372 Rev. Jan. 1989 (Copyright 1989).
*Air Conditioning, Heating and Refrigeration News,* Aug. 21, 1989.
*Wall Street Journal,* Wednesday, Sep. 6, 1989.

*Primary Examiner*—William E. Tapolcai
*Attorney, Agent, or Firm*—Wood, Phillips, VanSanten, Clark & Mortimer

[57] ABSTRACT

There is disclosed herein a refrigerant container in the form of a bag, or pouch, made from two sheets of multilayer barrier film material which are heat sealed adjacent their edges to form a closed pouch which has an interior space. The bag may be connected to an access valve provided in a line of a sealed refrigeration system for capturing the refrigerant therefrom. The barrier film material is specially formulated to prevent outward permeation of a refrigerant and to prevent inward permeation of air. A valve system is provided for filling and emptying the bag.

44 Claims, 7 Drawing Sheets

METHOD AND APPARATUS FOR RECOVERING REFRIGERANTS FROM HOME REFRIGERATION SYSTEMS

RELATED APPLICATION

This application is a continuation of application Ser. No. 661,463, filed Feb. 26, 1991, now Pat No. 5,293,756, which is a continuation-in-part application of Ser. No. 413,823, filed Sept. 28, 1989, now U.S. Pat. No. 4,996,848.

FIELD OF THE INVENTION

This invention relates to refrigeration apparatus and, more particularly, to an improved method and apparatus for recovering refrigerants therefrom.

BACKGROUND OF THE INVENTION

Refrigeration apparatus, such as refrigerators, freezers, dehumidifiers and air conditioners, include a sealed refrigeration system for providing cooling. A typical system includes a compressor, a condenser and an evaporator with intermittent recirculation of a refrigerant or coolant to provide cooling. A typical refrigerant used in refrigerators and freezers is known as R-12, while a typical refrigerant used in air conditioners is known as R-22.

Both of the above-mentioned refrigerants include chlorofluorocarbons (CFCs). In servicing refrigeration apparatus at the present time, CFCs are customarily released to the atmosphere. However, CFCs are believed to deplete the ozone layer from the atmosphere. This damages the atmosphere since the ozone layer filters harmful ultraviolet radiation from sunlight.

Occasionally, it is necessary to remove the refrigerant from a sealed system. For example, if a compressor needs to be replaced, or if there is an improper charge in the system, or if there is a flow restriction in the sealed system, then it is necessary for a service technician to evacuate the refrigerant from the sealed system prior to servicing. One commonly used method uses a long hose connected to a valve brazed on a line of the sealed system to purge the refrigerant either directly into the home, or outside the home. However, this procedure has caused concern among environmentalists as a result of its harmful effects to the ozone layer.

Various apparatuses are available for capturing the refrigerant removed from a sealed system. Examples of refrigerant recovery and capture devices are disclosed in Cain U.S. Pat. No. 4,261,178 and Lower et al. U.S. Pat. No. 4,441,330. However, these disclosed devices are believed to be heavy, bulky, complicated and expensive. In a recently reported survey, the available equipment for refrigerant recovery/recycling weighed from 40 to 600 lbs with an average weight of close to 150 lbs. The cost of such equipment varied from a low of $1,200 to as high as $24,000. While large repair shops may easily justify such expense, refrigerant 15 recovery is not performed often enough for most small repair shops to justify the cost of purchasing or acquiring the expertise to correctly use such equipment.

The present invention is directed to solving one or more of the problems set forth above, in a novel and simple manner.

SUMMARY OF THE INVENTION

In accordance with the present invention, a method and apparatus is provided for simply and inexpensively recovering refrigerants from a sealed system.

Broadly, there is disclosed herein an apparatus for capturing a refrigerant contained in a sealed, pressurized refrigeration system and which may be provided with an access valve on a refrigerant line of the system. The apparatus includes a refrigerant container comprising a plastic bag or pouch of a film material to define an interior space at atmospheric pressure, the film material being substantially inert and impervious to the refrigerant, compressor oil, and contaminants that may be found in a failed sealed system. Such contaminants mainly consist of acids, non-condensible gases, moisture and particulate matter. An opening is provided through the film material providing an inlet to the interior space. Means are provided for connecting the bag at the opening thereof to an access valve to permit the refrigerant to escape under pressure from the refrigeration system to the interior space of the bag.

It is a feature of the invention that the connecting means comprises a flexible hose connected between the access valve and the plastic bag.

It is another feature of the invention that the plastic bag is of a transparent material permitting inspection of the contents of the refrigerant captured therein.

It is a further feature of the invention that a desiccant, an alkali material, an active metal such as powdered iron and/or charcoal may be provided in the interior space of the plastic bag prior to or subsequent to capture of the refrigerant for interaction with the recovered contents in the plastic bag refrigerant container as a first step in purifying the refrigerant.

It is yet another feature of the invention that the connecting means comprises an adapter fitting secured to the plastic bag refrigerant container at the opening for connecting to the access valve.

It is an additional feature of the invention that the bag is comprised of laminate film material and having an adapter fitting assembled to one face of the disclosed bag or pouch.

According to another aspect of the invention, a system is provided for capturing refrigerant contained in a sealed, pressurized refrigeration system. The system includes an access valve for connection to a refrigerant line of the refrigeration system, and a plastic bag of laminate film material to define an interior space at atmospheric pressure, the film material being substantially inert and impervious to the refrigerant, compressor oil and sealed system contaminants. An opening is provided through the film material providing an inlet to the interior space for containing the refrigerant, etc. An adapter fitting is secured to the film at the inlet opening. A flexible hose is provided for connecting the adapter fitting to the access valve to permit the refrigerant to escape under pressure from the refrigeration system to the interior space of the bag.

More specifically, there is disclosed herein a bag, or pouch, made from a multi-layer barrier film material sealed to form a closed pouch having an interior space. The barrier film material is specially formulated and fabricated to prevent outward permeation of the refrigerant and to prevent inward permeation of air. A bulkhead fitting is provided for filling and emptying the bag.

The film material is also formulated to give very high elongation under stress, so that the pouch can hold a larger than designed volume. Further, the formulation allows for a non-explosive rupture if too much refrigerant is introduced into the pouch.

The bag is advantageously connected to the refrigeration system by a flexible hose. The highly pressurized liquid refrigerant boils out of the refrigeration system and escapes into the bag as a gas. The compressor in the sealed system may also be energized to pump the refrigerant into the pouch. When the refrigeration system has been emptied, the refrigerant in the bag may be purified and reused, or disposed of in an environmentally safe manner.

In accordance with another aspect of the invention, a method is disclosed for capturing refrigerant contained in a sealed, pressurized refrigeration system. The method comprises the steps of attaching an access valve to a refrigerant line in the system, connecting a plastic bag to the access valve, the bag being at atmospheric pressure and of a material substantially inert to the refrigerant, compressor oil and sealed system contaminants, opening the valve to permit the refrigerant to escape under pressure from the system into the bag, and subsequently closing the access valve, removing the bag from the access valve, and sealing the bag to prevent the captured refrigerant from escaping.

A typical refrigeration system includes a compressor having a high pressure side and a low pressure side. In accordance with the invention, if the compressor is operable, then the access valve is attached to the high pressure side of the compressor so that the compressor may act as a pump to remove the refrigerant from the system.

Further features and advantages of the invention will readily be apparent from the specification and from the drawings.

DESCRIPTION OF THE INVENTION

Figure 1:
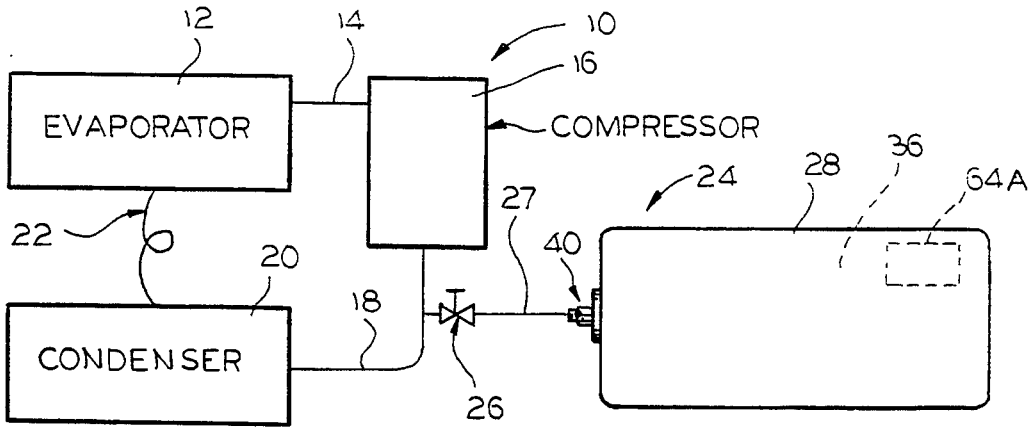
FIG. 1 is a schematic diagram of a system for capturing refrigerant from a home refrigeration system according to the invention.
Figure 5:
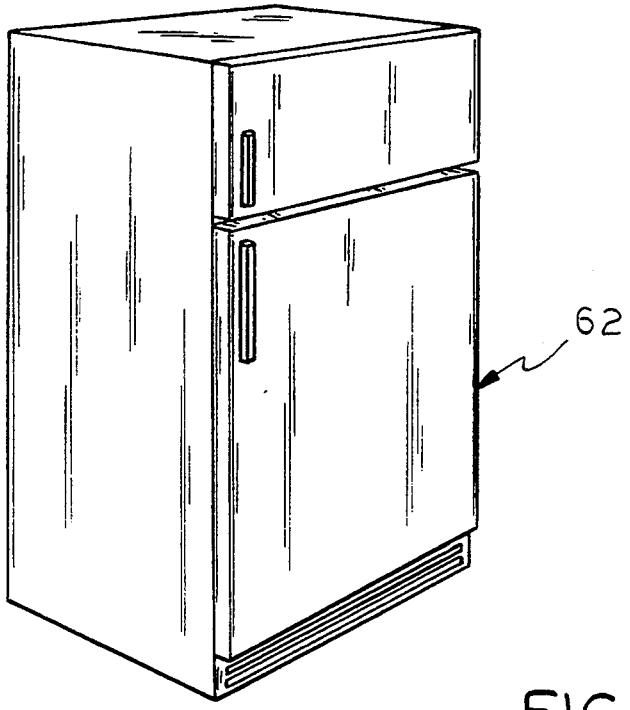
FIG. 5 is a perspective view of a refrigeration apparatus in the form of a refrigerator/freezer including a sealed pressurized refrigeration system.
Figure 6:
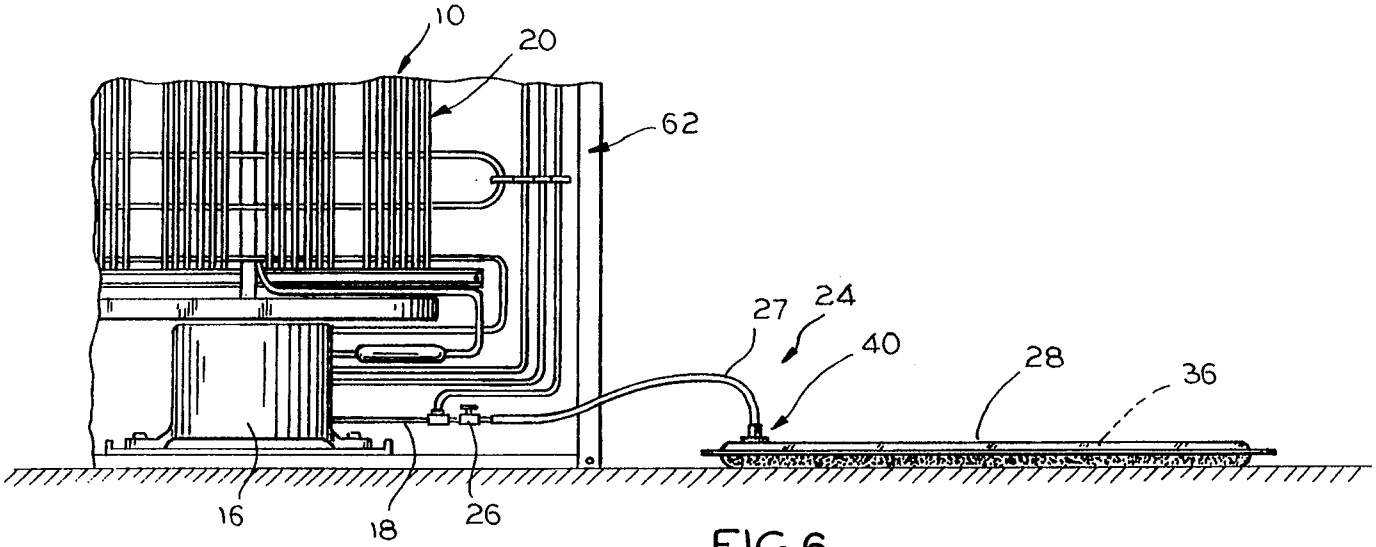
FIG. 6 is a rear elevational view of the refrigerator/freezer of FIG. 5 illustrating the plastic bag of FIG. 2 in a generally unfilled state connected to the refrigerator/freezer of FIG. 5 prior to the refrigerant capture process.
Figure 7:
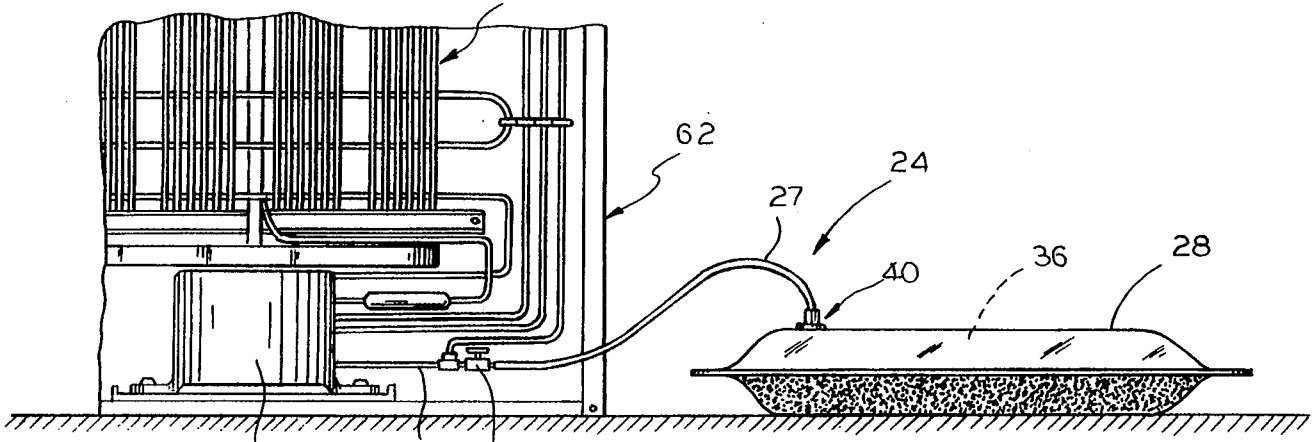
FIG. 7 is a rear elevational view of the refrigerator/freezer apparatus of FIG. 5 illustrating the plastic bag of FIG. 2 in a generally partially filled state connected to the refrigerator/freezer during the capture process.

With reference to FIG. 1, a schematic diagram illustrates a servicing apparatus and method for capturing a refrigerant contained in a sealed, pressurized refrigeration system 10. The invention may be used in connection with a refrigeration apparatus, such as a refrigerator, freezer, dehumidifier or air conditioner, as will be obvious to those skilled in the art. In the illustrated embodiment, the apparatus and method is used in connection with a typical home refrigerator/freezer such as shown in FIGS. 5–7.

The sealed system 10 includes an evaporator 12 connected by a conduit 14 to a compressor 16. The compressor 16 is connected through a conduit 18 to a condenser 20 which, in turn, is connected through a capillary tube 22 to the evaporator 12.

The system 10 is sealed and under pressure, as is well known. The sealed system includes a conventional refrigerant or coolant such as R-12 for providing a refrigeration effect. Specifically, as is well known, the evaporator receives the refrigerant in liquid form which subsequently evaporates to remove heat from the surrounding area. The evaporated refrigerant is in a gas form. The compressor 16 pumps and pressurizes the refrigerant vapor from the relatively low pressure conduit 14 through the high pressure conduit 18 to the condenser 20. The high pressure and the cooling causes the vapor to condense back to liquid refrigerant for recirculation through the capillary tube 22 to the evaporator 12.

A system 24 is provided for removing and capturing the refrigerant from the refrigeration system 10. This operation may be necessary, for example, if there is a failure in the refrigeration system, if there is a low charge of refrigerant in the system 10, or if there is some restriction within the sealed system 10.

The recovery and capture system 24 includes an access valve 26, a flexible hose 27, a bag access valve or filling adapter 40, and a refrigerant container in the form of a plastic bag, or pouch, 28 according to the invention.

The access valve 26 may be of any known form which can be installed on a refrigerant line such as the conduit 18 when the system is operable. Particularly, a conventional access valve 26 is brazed in the line with the conduit 18 and the conduit 18 is subsequently punctured to provide a connection between the valve 26 and the conduit 18. Alternatively, the access valve 26 could be preinstalled in the refrigeration system 10. Also, if a removal procedure has previously been performed on the refrigeration system 10, then an access valve would already be in place.

Figure 2:
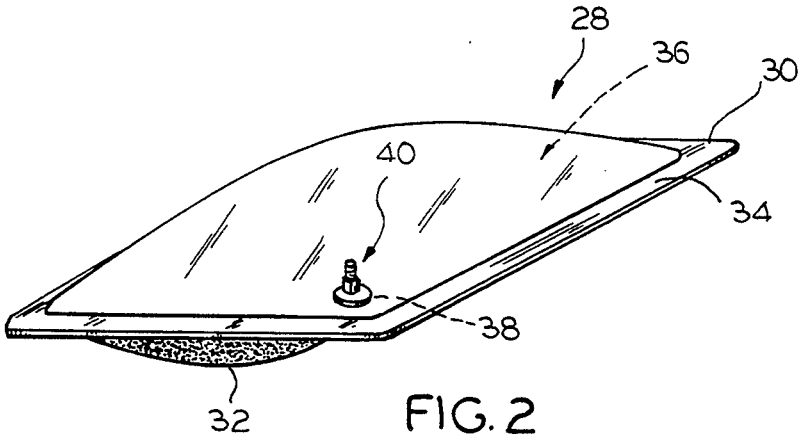
FIG. 2 is a perspective view of the refrigerant container portion of the apparatus of FIG. 1 for capturing the refrigerant and comprising a plastic bag or pouch according to the invention.
Figure 3:
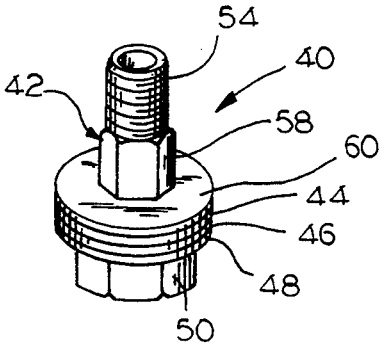
FIG. 3 is a perspective view of an adapter fitting of the plastic bag of FIG. 2.

With reference to FIG. 2, the bag 28 comprises a top sheet 30 and a bottom sheet 32, both sheets consisting of an assembly of multi-layer barrier film material. The sheets 30 and 32 are sealed together, using a heat sealing or other suitable sealing process, around a peripheral seal area, as at 34, to form a closed bag having an interior space 36. The barrier film material of each sheet 30 and 32 is specially formulated and fabricated to prevent outward permeation of a refrigerant contained in the space 36 and to prevent inward permeation of air into the space 36. Further, it is desirable that the sheets 30 and 32 be made of a material which is inexpensive, is maintained at low pressure for safety, permits visual examination of the contents of the refrigerant, and is reusable.

Figure 8:
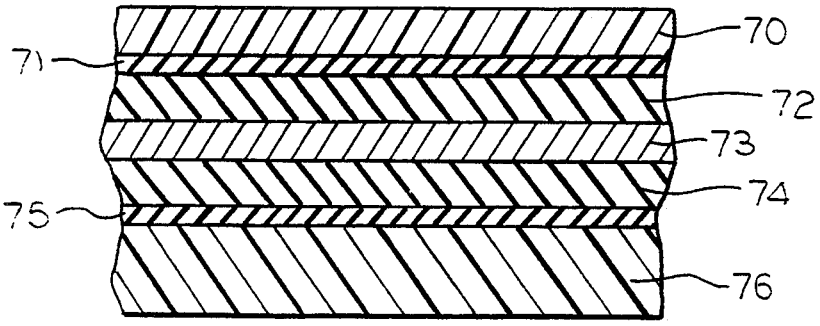
FIG. 8 is a view of a greatly enlarged wall portion of the plastic bag refrigerant container showing the various layers in one wall of the container.

One material found to be satisfactory for the indicated needs is a forming film sold by Cryovac Division of W. R. Grace Company under the designator T6040B. This forming film is of multi-layer construction as shown in FIG. 8 and includes the layers listed below and identified by the reference numerals shown in FIG. 8:

1. Oriented Polypropylene (Outer Layer 70)
2. Adhesive 71
3. Nylon 72
4. Ethylene Vinyl Alcohol Copolymer 73
5. Nylon 74
6. Adhesive 75
7. Linear Low Density Polyethylene Heat Seal Adhesive (Inner Layer 76)

The linear low density polyethylene heat seal adhesive layer 76 is inert to the CFCs in the refrigerant, to compressor oil which may be contained in the refrigerant, and to the contaminants which may be found in a failed sealed system. Any reaction or excessive adsorption of either the compressor oil or the refrigerant with the bag could cause failure and loss of the refrigerant to the atmosphere. The polyethylene also provides elasticity. If the bag is overfilled with refrigerant, then it must have the elasticity to expand rather than burst. The nylon layers 72, 74 provide toughness. Specifically, a degree of resistance against puncture is required, which resistance is provided by the nylon layers 72 and 74. Finally, the ethylene vinyl alcohol copolymer layer 73 provides a barrier to the diffusion of air. Diffusion of air into the refrigerant bag would make the purification of the refrigerant very difficult to perform.

Another material found to be satisfactory is a film sold by James River Corporation under the designation Z520. This film is also of multi-layer construction and includes the layers listed below:

1. Linear Low Density Polyethylene
2. Adhesive
3. Nylon
4. Adhesive
5. Linear Low Density Polyethylene Each of these layers functions similar to corresponding layers in the film shown in FIG. 8. In this instance, the nylon, in addition to providing toughness, acts as a barrier to the diffusion of air.

In the illustrated embodiment, the upper sheet 30 is of transparent plastic, while the lower sheet 32 is of colored plastic material. Alternatively, both sheets 30 and 32, or at least a portion of one of them, could be of transparent plastic material. The use of the transparent material permits a serviceman to immediately visually analyze the contents of the refrigerant to determine the cause of the sealed system failure. For example, a burnt compressor failure will be evident by burnt compressor oil which is much darker in color and which can be seen through the transparent sheet 30.

An opening 38 is provided through the top sheet 30 for providing in inlet to the space 36. The bag access valve or filling adapter 40 is secured to the top sheet 30 at the opening 38 to form a bulkhead fitting with the bag 28.

The filling adapter 40 comprises a coupling element 42, first and second neoprene washers 44 and 46, an aluminum washer 48 and a hexnut 50. The coupling element 42 comprises an elongated tube 52 including a threaded outer end 54 and an opposite threaded inner end 56. The threaded inner end 56 is provided with a rounded or smoothed edge to prevent puncturing of the sheets 30 and 32. Disposed immediately inwardly of the threaded outer end 54 is a midportion 58 including flattened surfaces much as with a hexnut, for receiving a wrench, and having an inner flange 60, such as a washer. The coupling element 42 may be formed of aluminum, or other material as necessary or desired. In the illustrated embodiment, the coupling element 42 is of unitary construction. Alternatively, the coupling element could comprise a threaded tube receiving a hexnut and washer or comprise a threaded tube that is adhesively bonded or sealed to the sheet 30.

The filling adapter 40 is secured to the sheet 30 as by installing the first neoprene washer 44 on the coupling element inner end 56 so that it abuts the flange 60. The coupling element inner end is then inserted through the opening 38 in the first sheet 30 and it then receives the second neoprene washer 46 and the aluminum washer 48. Finally, the hexnut 50 is threadably secured to the coupling element threaded inner end 56 to provide a secure sealed connection. Preferably, the hexnut 50 also has rounded edges to prevent perforation of the sheets 30 and 32.

The refrigerant container 28 of the present invention is advantageous in that it is very light and easily handled. The bag or container 28, when empty, weighs approximately ½ lb. One tested container 28, of a capacity large enough to hold the refrigerant from three refrigerators of a twenty cubic foot interior volume, weighed less than four lbs. when full of captured refrigerant.

With reference to FIGS. 6 and 7, the use of the recovery and capturing system 24 and a method for capturing the refrigerant is generally illustrated.

Initially, a service technician installs the access valve 26 in the conduit 18 between the compressor 16 and the condenser 20 of a conventional domestic refrigerator/-freezer 62. The access valve 26 can be installed in the conduit 18 in any known manner, such as by brazing the valve 26 to the conduit 18 and thereafter puncturing the conduit 18, as is well known. With the valve 26 being closed, the flexible conduit 27 is connected to the valve 26 at one end with the other end being threadably connected to the outer threaded end 54 of the filling adapter coupling element 42. As such, a direct connection is provided between the compressor outlet high pressure conduit 18 and the interior space 36 of the bag 28, with the access valve 26 interposed therebetween.

Once the connection has been completed, then the access valve 26 is opened. Since the sealed system is under pressure owing to the operation of the compressor 16, the refrigerant in the sealed system 10 is caused to be pumped through access valve 26 and the flexible hose 27 into the interior space 36 of the bag 28. The bag 28 is initially in a generally flattened state, as illustrated in FIG. 6, and subsequently expands to a partially filled state, as illustrated in FIG. 7.

Once the refrigerant has transferred from the sealed system 10, then the access valve 26 is closed and the flexible hose 27 removed from the adapter 40 and immediately a cap 64, containing a neoprene washer or O-ring (not shown), is put on the adapter 40, then the hose 27 is disconnected from the valve 26. Although the adapter 40 is temporarily opened, it has been found that due to the low pressure and weight of the refrigerant (five times the weight of air) contained in the space 36, little, if any, escapes into the atmosphere. The bag 28 is then ready for transfer to a recycling or disposal location.

In the illustrated embodiment, the access valve 26 is connected on the high side line of the compressor 24. If the compressor is inoperative, then an additional valve may be provided at the low side of the compressor which is used to cause the removal of the pressurized refrigerant.

Depending upon the location of the access valve 26, the refrigerant may be liquid or gas. However, if the refrigerant is liquid, then it will evaporate to a gas as it is exposed to atmospheric pressure.

In one embodiment which has been subjected to tests, the bag 28 utilizes sheets 30 and 32 which are rectangular in shape and are thirty-six inches wide by forty-eight inches long, with a heat seal being provided immediately adjacent the outer edges thereof. Such a bag is sufficient to hold twenty-eight ounces by weight of R-12 refrigerant at 140° F. This is sufficient volume to service a typical refrigerator/freezer sealed system and, in fact, can be used to service as many as three sealed systems.

The tested size is indicated for illustrative purposes, and is not limiting. However, it is desirable that the bag be of sufficient size to prevent against careless use by a technician. Particularly, if the bag is overfilled with refrigerant and liquid refrigerant is subsequently added, then the bag can break.

The use of the disclosed multi-barrier layered film material provides a bag which is safe for a user thereof and any observers. The bag is never more than one psi above atmospheric pressure. In tests, the use of the film material permits expansion to approximately 350% of bag volume prior to breakage. In fact, in tests arranged to provide extreme high pressure conditions, the bag 28 failed by biaxial extension, always remote from the heat seal area 34 or adapter 40. The pressure goes through a peak after which the bag 28 is in a yielding mode and the pressure thus decreases. In view of the above, it is believed that it would be extremely difficult for a user under ordinary circumstances to overfill a bag 28 to the point of rupturing. Even if a fully loaded bag 28 is placed in a hot environment, the bag 28 will yield to swell further to accommodate the extra volume. Because the bag 28 is of such low pressure, it is not necessary to utilize a valve in the adapter 40.

By using the disclosed film material and adapter 40, the bag 28 is relatively inexpensive, estimated at approximately $20.00 per unit. Thus, it can easily be afforded by small repair shops and service operations and it can be used in a safe and efficient manner to remove and capture refrigerants.

The use of the above-described system and method permits a technician to immediately take steps which are useful in the recycling and/or disposal of the refrigerant. As discussed above, the refrigerant purged into the bag 28 contains compressor oil and may include contaminants from the sealed system. In the bag 28, the refrigerant separates from the compressor oil and any possible contaminant. Thus, when the refrigerant is removed from the bag for recovery or disposal it can be done without the contaminants or compressor oil, thus providing initial purification of the refrigerant, In order to enhance additional steps of purification, a material, illustrated schematically at 64A in FIG. 1, can be inserted in the bag interior space 36, before or after the capturing of the refrigerant.

One of the major difficulties of purifying refrigerant is the removal of acidity. Acidity removal can be accomplished by using an alkali material. Therefore, according to one embodiment, the material 64A comprises an alkali material which is inserted into the bag. A typical such material is calcium hydroxide which would be effective to remove the acidity from the refrigerant which has been captured.

Another step in purifying the refrigerant is the removal of organic hydrocarbons. Thus, according to another embodiment of the invention the material 64A could comprise charcoal in some form which would remove some of the hydrocarbons from the refrigerant.

The oxygen in any air captured in the bag will in subsequent processing react and oxidize matter in the bag. According to a further embodiment of the invention, the material 64A can comprise an oxygen scavenger material such as an active iron powder package which removes the oxygen from the bag.

Finally, the material 64A may comprise a desiccant for removal of moisture from the refrigerant during a recovery and capture process.

Figure 9:
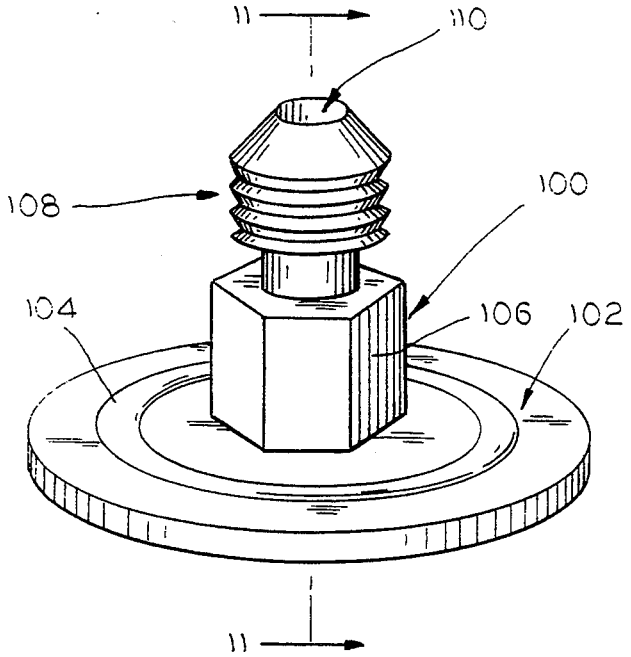
FIG. 9 is a perspective view of an alternate adapter fitting for the plastic bag.
Figure 11:
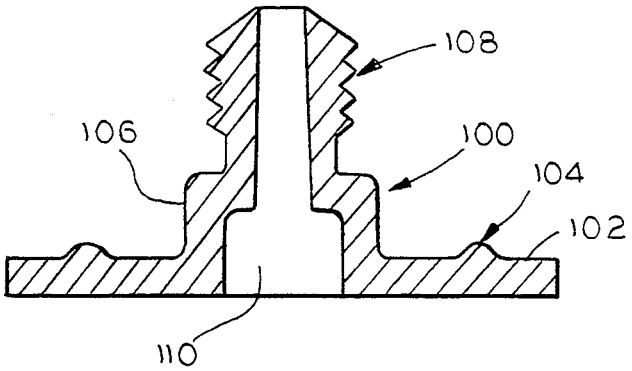
FIG. 11 is a sectional view taken along the line 11—11 of FIG. 9.
Figure 10:
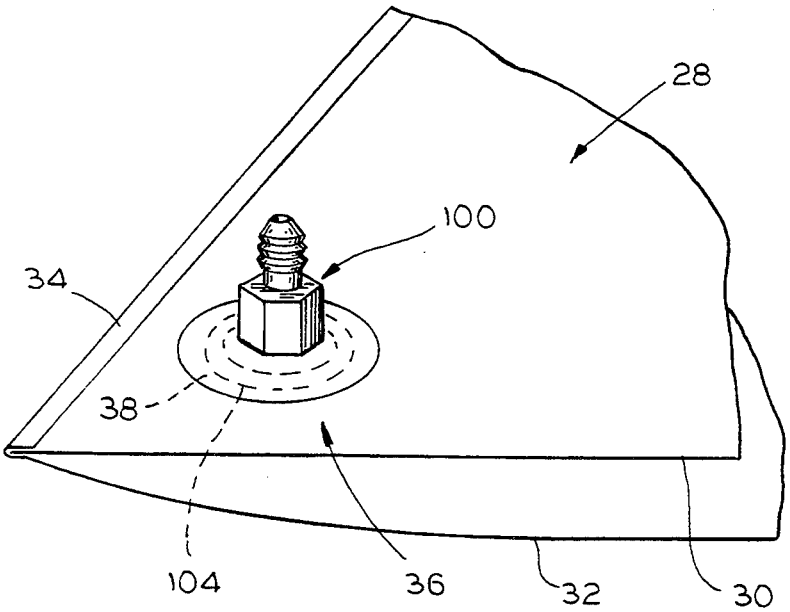
FIG. 10 is a perspective view of the adapter fitting of FIG. 9 installed in a plastic bag according to the invention.

With reference to FIGS. 9–11, a filling adapter 100 is illustrated which is believed to be less expensive and easier to install than the adapter 40 described above. The adapter 100 differs in that it is heat sealed to the top sheet 30, rather than being connected using a threaded coupling element.

The adapter 100 is made of a plastic that can be heat sealed to the bag material. The heat sealing can be done by applying a heated element directly to the material or by using radio frequency waves. Since the bag material inner layer is made of a linear low density polyethylene material, the adapter 100 must be made of the same material or one that will adhere to this type of material. Low density polyethylene is a preferable material since it will adhere to most available heat layer materials, and is also resistant to attack from the refrigerant and the associated refrigerant oils. Further, low density polyethylene is relatively inexpensive.

Figure 4:
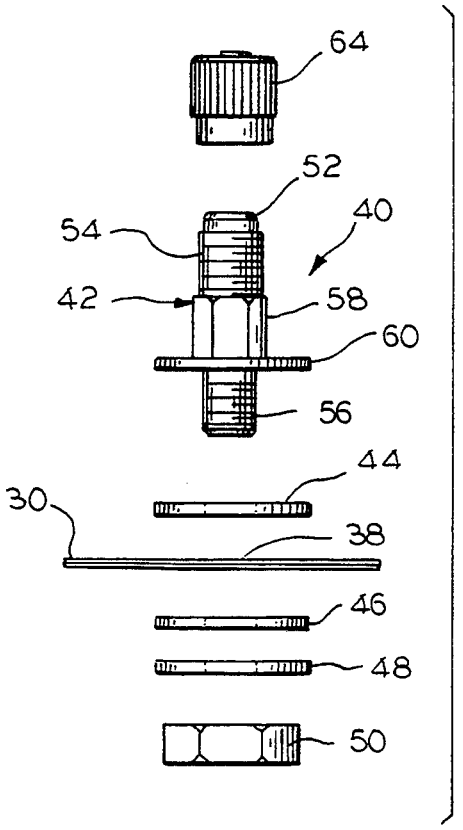
FIG. 4 is an exploded view illustrating how the adapter fitting of FIG. 3 is secured to the plastic bag.

The adapter 100 can be injection molded and includes a relatively thin flange 102 including a circular raised ridge 104. Extending upwardly from the flange 102 is a midportion 106 including flattened surfaces much as with a hexnut, for receiving a wrench, and an outer threaded portion 108. The threaded portion 108 can be used for receiving a flexible hose to connect to the refrigeration system, as discussed above relative to the adapter 40. The threaded end 108 may be configured as a three-eighth inch SAE tapered tube fitting. The closure feature, similar to the cap 64, see FIG. 4, can be used to maintain a refrigerant within the space 36. An elongate central opening 110 is provided through the adapter 100 to provide communication of refrigerant from the refrigeration system to the interior of the bag 28.

To assemble the adapter 100 to the bag 28, the bag 28 is formed with heat seals around three of the four side edges. The adapter 100 is then inserted into the space 36 with the upper portion extended through the opening 38. The area on the bag top sheet 30 surrounding the opening 38 is heat sealed, such as with a vibration weld at the ridge 104 to provide a sealed connection between the adapter 100 and the bag 28.

Once the adapter 100 is sealed to the top sheet 30, then the fourth side edges of the bag can be sealed together to complete the construction.

Figure 12:
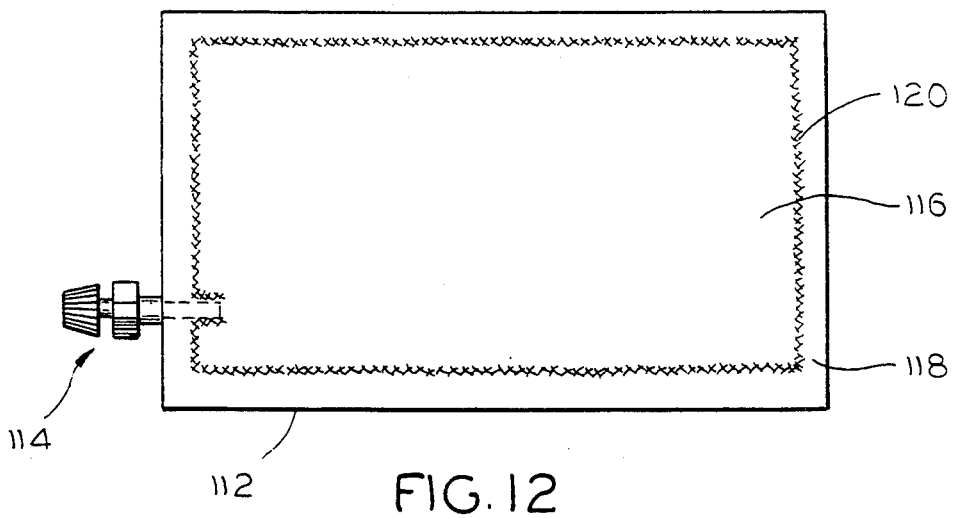
FIG. 12 is a plan view of a plastic bag or pouch according to an alternative embodiment of the invention including an adapter fitting mounted between top and bottom sheets which form the plastic bag.

With reference to FIG. 12, a refrigerant recovery bag 112 according to another embodiment of the invention is illustrated. The bag 112 is generally similar to the bag 28 discussed above, except that no hole is provided in either sheet for receiving an adapter fitting. Instead, an adapter fitting 114 communicates with a bag interior space 116 as by being inserted between two sheets of film material 118, which are heat sealed about the periphery as at 120.

Figure 13:
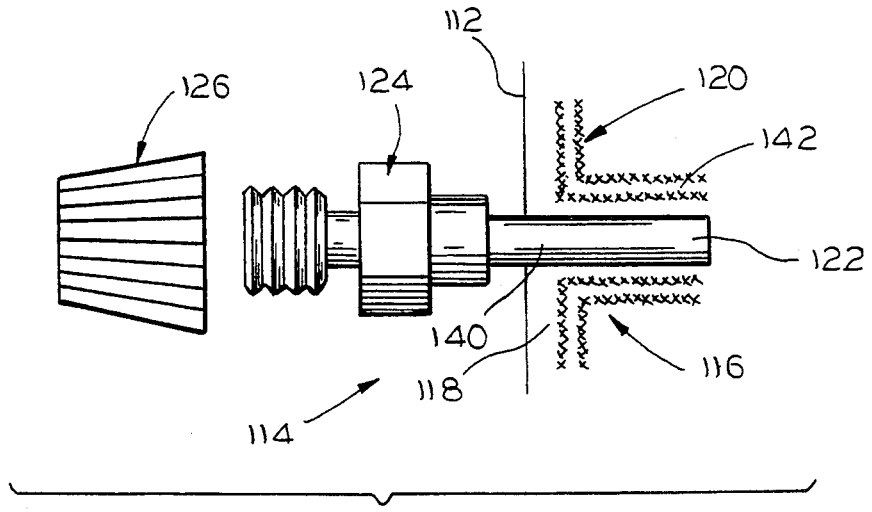
FIG. 13 is an enlarged view of the installation of the adapter fitting in the plastic bag of FIG. 12.
Figure 14:
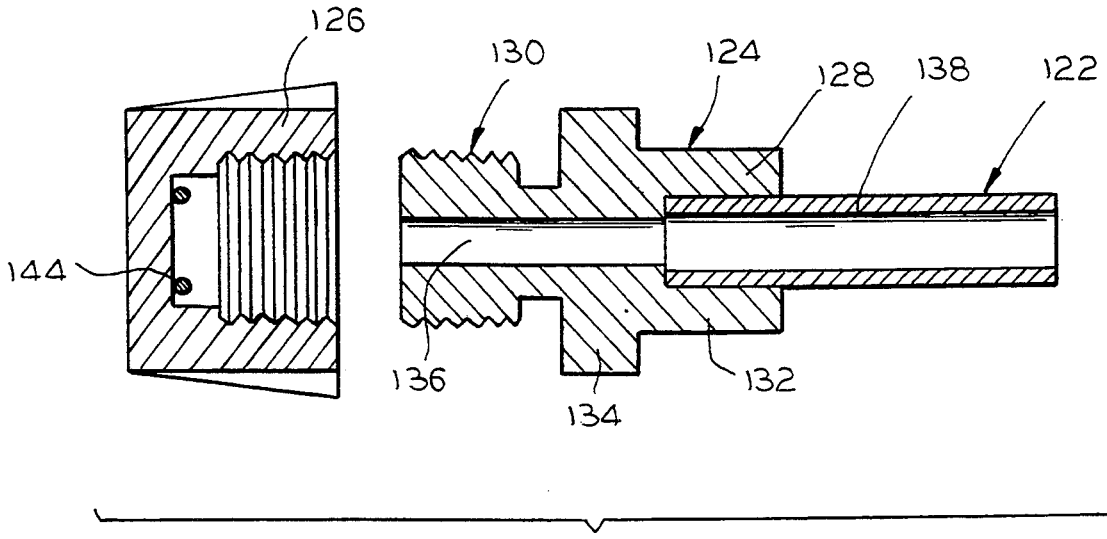
FIG. 14 is a sectional view of the adapter fitting of FIG. 13, the bag material being removed for clarity.

With reference to FIGS. 13 and 14, the adapter 114 includes a relatively short length of tubing 122, a coupling element 124 and a cap 126. The coupling element 124 comprises an elongated tube 128 including a threaded outer end 130 and an opposite enlarged inner end 132. Disposed between the ends 130 and 132 is a midportion 134 including flattened surfaces much as with a hexnut, for receiving a wrench. An elongate bore 136 extends through the tube 128 and includes an enlarged bore portion 138 at the inner end 132. The tube 122 is inserted in the enlarged bore portion 138 and can be joined together by a suitable adhesive or heat seal, as necessary or desired. The particular form of adhesion used must be resistant to the refrigerant and to compressor oil. The tube 122 can be flexible or rigid.

To install the adapter 114, the tube 122, adhered to the coupling element 124, is inserted between the two sheets of film 118. The two sheets 118 are sealed around the periphery of each as at 120 except for a small opening area 140 where the tube 122 is inserted. A suitable fixture is used to heat seal the two sheets 118 at an area 142 adjacent the tube 122 on either side. Also, the film itself is heat sealed to the tube 122 to entirely close off and seal the area surrounding the tube 122. This gives strength to the bag 112 and to the interface between the adapter 114 and the bag 112.

The cap 126 includes an O-ring 144 internally thereof for providing a sealed connection when the cap 126 is threaded onto the coupling element threaded end 130 after refrigerant has been captured in the space 116.

Figure 16:
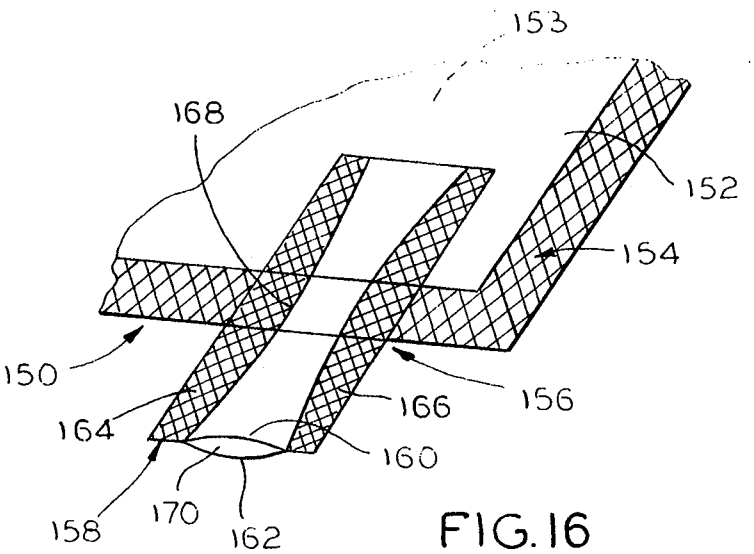
FIG. 16 is an enlarged view of the valve fitting of FIG. 15.
Figure 15:
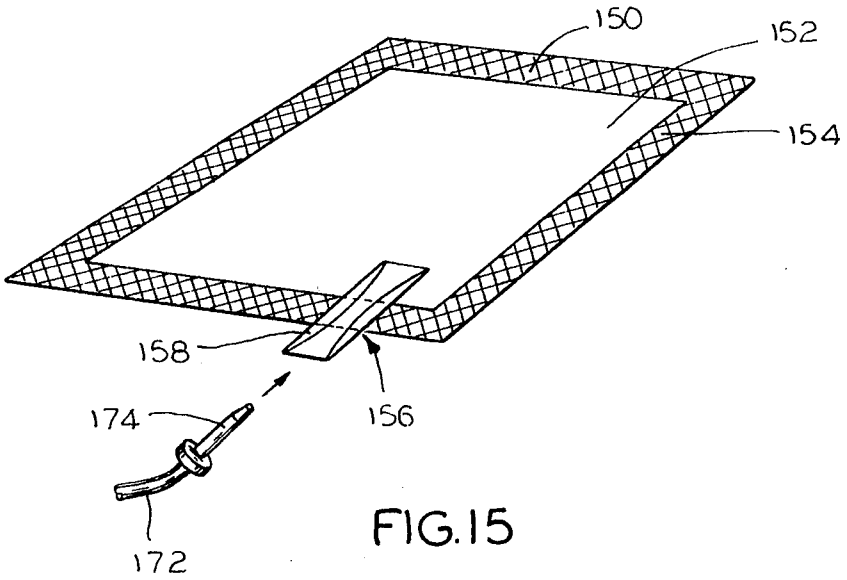
FIG. 15 is a perspective view of a plastic bag or pouch according to another alternative embodiment of the invention including a self-sealing valve fitting.

With reference to FIGS. 15 and 16, a refrigerant capture bag 150 according to another embodiment of the invention is illustrated. The bag 150 is formed of two sheets of film material, as discussed above, heat sealed about their periphery as at 144 except for a relatively short length to provide an opening 156 therebetween. A self-sealing valve 158 is received and secured in the opening 156.

The self-sealing valve 158 is made of two layers of sheet film that are closed by the internal pressure in the bag. The valve must be made using a low modulus film to allow it to be sealed by the low internal bag pressure. Advantageously, such a material must be heat sealed along both faces to itself and to the inside surface of the bag. The James River Company material described above can be used to form the valve. This is a low modulus material and at thicknesses below two milo, or preferably at or below one mil., can form a valve that closes quite readily.

The valve 158 consists of an upper sheet 160 and a lower sheet 162 heat sealed at areas 164 and 166 about opposite edges. Preferably, the heat seal areas 164 and 166 are more closely spaced at a midportion than at opposite ends. The valve 158 is inserted in the opening 156 and the bag upper sheet 152 is adhered to the valve upper sheet 160 as at 168. A similar heat sealing is done on the underside of the valve bottom sheet 162 to the bag bottom sheet (not shown). As is apparent, a suitable device, such as a strip of material, coated with Teflon ® Tetrafluoroethylene-resin, which can be removed, must be inserted in the valve opening 170 when heat sealing the valve to the bag 150 to avoid closing off the valve 158.

In order to capture the refrigerant, a flexible hose 172 is connected to a refrigeration system, as discussed above. Connected to an opposite end of the hose 172 is an insertion tube 174 which can be inserted in the valve opening 170. In order to prevent leakage of the refrigerant during loading, the design of the valve 158 should be selected to require a press fit of the insertion tube 174. This is accomplished by the tapering of the opening 170, as discussed above, and providing an opening that is slightly smaller than required for the insertion tube 174. Insertion of the tube 174 will slightly expand the seal area and causes a snug, relatively leak-free seal around the insertion tube 174 during bag filling. The inner portion of the valve 158 must extend sufficiently into the bag interior space 153 so that it can be gripable by an operator during extraction of the insertion tube 174 to prevent the valve 158 from being turned inside out. Once the insertion tube 174 is removed, the relatively low pressure of the refrigerant in the space 153 will close the valve 158. A small amount of lubricant, such as mineral oil, can be applied internally to the valve opening 170 to effect a better seal at very low pressures.

Figure 19:
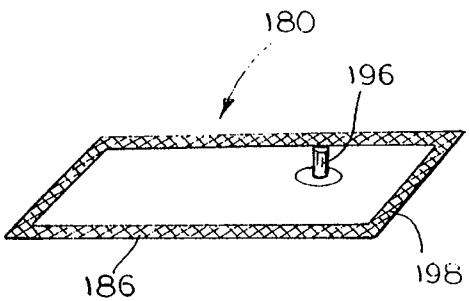
FIG. 19 is a perspective view of the bag of FIG. 18 with all edges sealed together.
Figure 18:
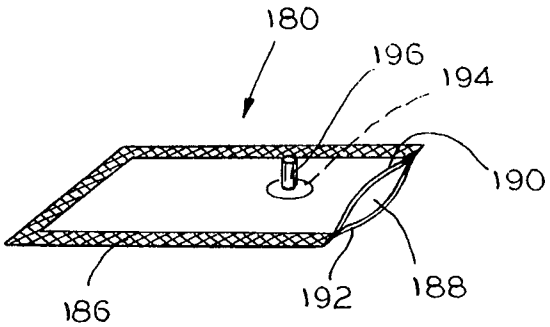
FIG. 18 is a perspective view showing a plastic bag formed of the sheets of FIG. 17 and including an open end for installing an adapter fitting.
Figure 17:
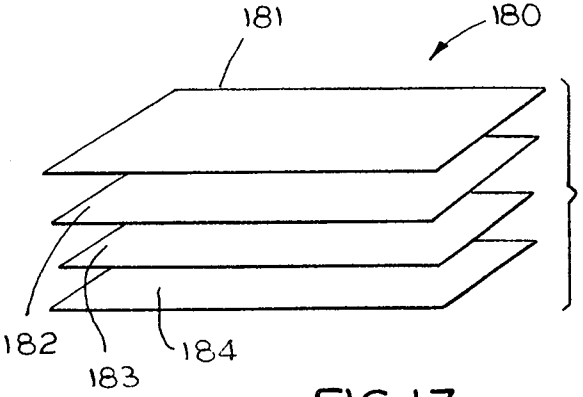
FIG. 17 is a perspective view showing sheets of film material used for a plastic bag or pouch according to yet another alternative embodiment of the invention.

During use by an operator, and in transporting the bags from one job to another, any of the bags discussed above can be subjected to varying conditions which could cause damage to the bag. In order to minimize damage to the bag, a "bag in a bag" or multi-layer bag 180 is shown in FIGS. 17–19. The bag 180 is formed of four sheets 181–184 of sheet material. In one embodiment of the invention, each of the sheets 181–184 is formed of the James River Corporation Z520 sheet material. Each of the sheets 181-184 is of rectangular shape and similar size. The sheets 181-184 are stacked in a layer configuration, as shown in FIG. 17 in exploded view. With the sheets stacked together and their edges aligned, the four sheets are sealed together around three sides as at 186, see FIG. 18. The resulting configuration provides an inner interior space 188 between the second and third sheets 182 and 183, and opposite outer interior spaces 190 and 192. The outer space 190 is between the sheets 181 and 182, while the outer space 192 is between the sheets 183 and 184. The inner interior space 188 is used for capturing the refrigerant. As it is surrounded by the spaces 190 and 192 on opposite sides, it can be referred to as a "bag in a bag".

A suitable opening 194 is provided between the top two sheets 181 and 182 and an adapter fitting 196 is inserted therethrough and suitably fastened. Either of the adapters 40 or 100, discussed above, can be used in this application. Once the adapter 196 is installed, then the fourth edge 198 of the four sheets can be sealed together to complete the construction.

With such a "bag in a bag" structure 180, small punctures or tears in the outer bag, formed of the sheets 181 and 184, are not communicated into the inner interior space 188. Thus, the bag 180 will retain the refrigerant, except for any small amount that might diffuse through both the inner bag and then leak through any pinhole in the outer bag. The inner bag formed of the sheets 182 and 183 can be of the same material as the outer sheets 181 or 184. Alternatively, the inner pouch may be of a simpler material such as ultra-low density polyethylene, the outer layers 181 and 184 being used to provide the necessary toughness.

Figure 20:
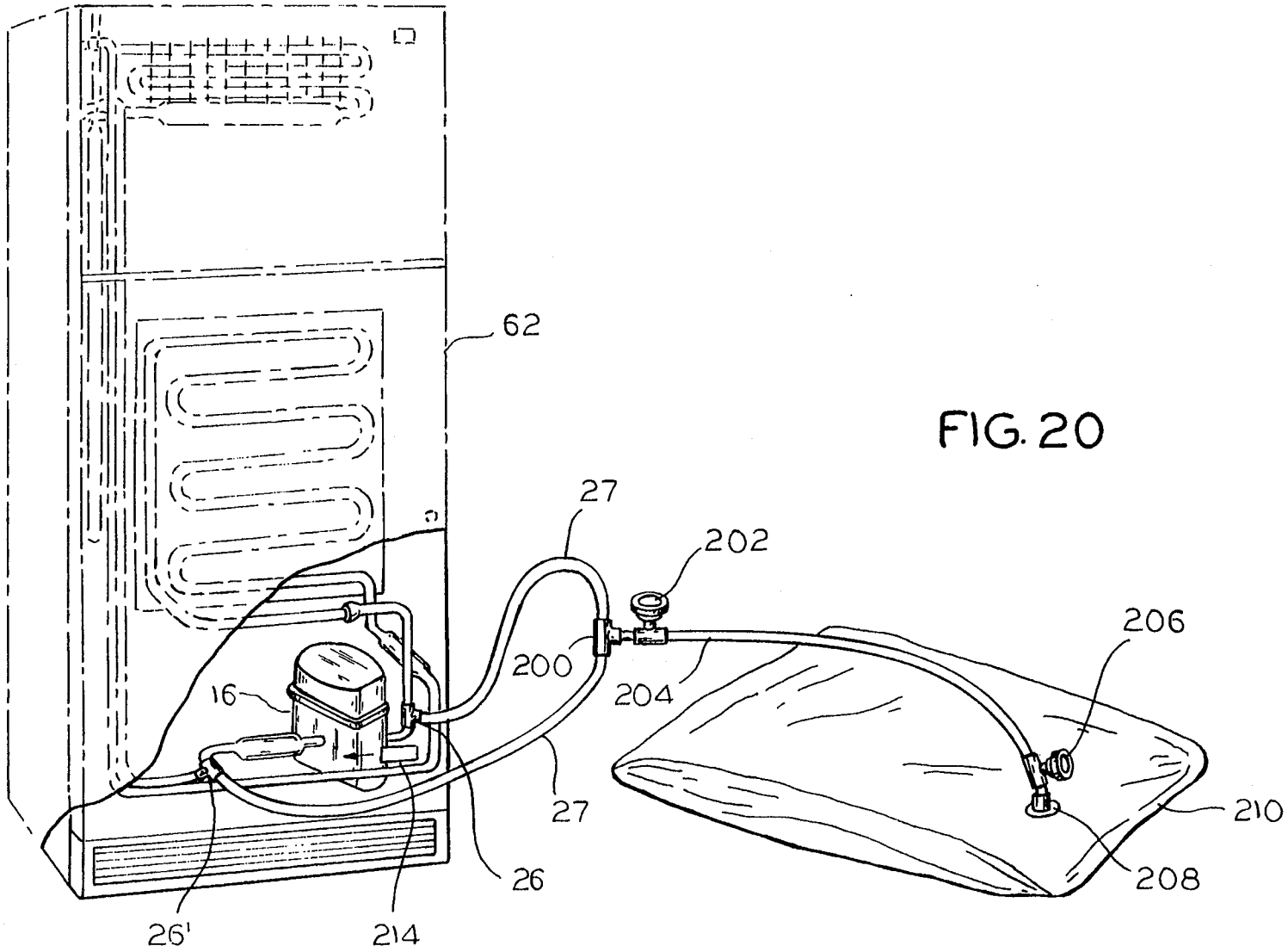
FIG. 20 is a rear perspective view of a refrigerator/freezer illustrating the plastic bag of FIG. 2 in a partially filled state connected to a refrigerator/freezer having an inoperable compressor.

There is discussed hereinabove relative to FIGS. 6 and 7, a method of recovering and capturing refrigerant from a refrigerator 62. Such a procedure is normally utilized when the refrigerator/freezer 62 includes an operating compressor. With reference to FIG. 20, an alternative set-up is shown for an instance where the refrigerator/freezer 62 includes an inoperative compressor 16.

Initially, a service technician installs the access valve 26 at the high pressure side of the compressor 16. A second access valve 26' is installed at the suction side of the compressor 16. The access valves 26 and 26' can be installed in any known manner, such as by brazing the valves 26 and 26' to the associated conduits and thereafter puncturing the conduits, as is well known. First and second flexible hoses 27 and 27' connect the respective access valves 26 and 26' to a T connector 200. A first hand valve 202 is connected between the T connector 200 and another flexible hose 204 which is connected via an additional hand valve 206 to an adapter 208 of the recovery bag 210. The recovery bag 210 may take any of the forms discussed in the present application.

Once the connection has been completed, then with the valves closed, heat is applied to the bottom of the compressor 16, as illustrated. This heat can be applied, for example, with a portable heat gun. With a nonoperational compressor, the refrigerant is mixed with compressor oil. However, heated compressor oil dissolves less refrigerant than cold oil. The application of heat releases refrigerant from the compressor oil. Thus, heat should be directed for the portion of the compressor 16 where the oil is located.

After approximately ten minutes of heating, all of the valves are opened to release refrigerant from the compressor 16 to the bag 210. In accordance with the invention, application of heat continues for an additional period of time, such as, for example, five minutes. It has been found that providing additional heat during the collection process provides recovery improvement on the order of 8–9%.

It has been found that "rapping" the compressor 16 with a device, such as a rubber mallet 214, at a select time during the recovery process can further improve recovery. A time interval on the order of two minutes after the access valves are open has been found to be satisfactory. The selected time must be sufficient so that system pressure is near atmospheric pressure so that the refrigerant is not at solution equilibrium. The remaining three minutes of heating time after the rapping occurs allow additional time for gas release. It has been found that the use of both the heating and rapping provides recovery improvement on the order of 16–17% over prior procedures which only heated the compressor prior to opening the access valves.

Once the above time periods have elapsed, then the valves can be again closed and the bag 20 removed for servicing the captured refrigerant at a suitable location, as discussed above.

Thus, in accordance with the invention, a simple and inexpensive apparatus and method is provided for recovering and capturing refrigerants from a sealed refrigeration system.

The foregoing disclosure is illustrative of the broad inventive concepts comprehended by the invention.

We claim:

1. A method of capturing refrigerant contained in a sealed, pressurized refrigeration system including an access valve on a line of said system, comprising the steps of:

connecting a plastic bag to said access valve, said bag being at atmospheric pressure and of a material inert to the refrigerant and other contents of the sealed system;

opening said valve to permit said refrigerant to escape under pressure from said system to said bag and subsequently closing said access valve;

removing said bag from said access valve so that the bag is open to atmospheric pressure; and sealing said bag to prevent the captured refrigerant from escaping.

2. The method of claim 1 wherein said connecting step further comprises the step of connecting a flexible hose directly between said access valve and said plastic bag.

3. The method of claim 1 wherein said refrigeration system includes a compressor having a high pressure side and a low pressure side and said attaching step comprises attaching said access valve to the high pressure side of said compressor.

4. The method of claim 3 wherein said compressor is operated as a pump to facilitate removal of the refrigerant from said refrigeration system.

5. The method of claim 1 wherein at least a portion of said plastic bag is of a transparent material and further comprising the step of inspecting the contents of the refrigerant captured in said bag.

6. The method of claim 1 further comprising the step of inserting a desiccant-in said plastic bag to remove moisture from the captured refrigerant.

7. The method of claim 1 wherein said connecting step comprises the step of providing a bag of a laminate film material and having an adapter fitting for connecting to said access valve.

8. The method of claim 1 wherein said connecting step comprises the step of providing a bag of a pair of sheets of a laminate sheet material heat sealed together and having an adapter fitting assembled to one of said sheets.

9. The method of claim 1 wherein said refrigeration system includes an inoperative compressor having a high pressure side and a low pressure side and said attaching step comprises attaching an access valve to each side of said compressor and said bag is connected to each said valve and said opening step comprises the step of opening both said access valves.

10. The method of claim 9 further comprising the step of heating said compressor while said access valves are open to facilitate removal of refrigerant from said compressor.

11. The method of claim 9 further comprising the step of rapping said compressor with an instrument while said access valves are open to facilitate removal of refrigerant from said compressor.

12. The method of claim 1 wherein said connecting step further comprises the step of connecting one end of a flexible hose to said access valve and inserting a tube at another end of said hose into a self sealing valve in said plastic bag.

13. The method of claim 9 further comprising the steps of heating said compressor while said access valves are open to facilitate removal of refrigerant from said compressor, and rapping said compressor with an instrument while said access valves are open to facilitate removal of refrigerant from said compressor.

14. An apparatus for capturing refrigerant contained in a sealed, pressurized refrigeration system having a refrigerant line providing access to said system, comprising:

a plastic bag of a film material to define an interior space at atmospheric pressure, the film material being inert to the refrigerant and other contents of the sealed system;

an access opening defined by said film material providing an inlet to said space;

means for connecting said bag at the opening thereof to said sealed system to permit said refrigerant to escape under pressure from said refrigeration system to the interior space of said bag, said bag being adapted to maintain refrigerant in the interior space when the connecting means is removed and the interior space is again at atmospheric pressure; and means for sealing said opening to prevent captured refrigerant from escaping.

15. The apparatus of claim 14 wherein said connecting means comprises a flexible hose between said plastic bag and a valve in said refrigerant line.

16. The apparatus of claim 14 wherein at least a portion of said plastic bag is of a transparent material permitting inspection of the contents of the refrigerant captured in said bag,

17. The apparatus of claim 14 further comprising a desiccant in the interior space of said plastic bag to remove moisture from the captured refrigerant.

18. The apparatus of claim 14 wherein said opening comprises an opening through said film material and said connecting means comprises an adapter fitting secured to said film material at the opening for connecting to said refrigerant line.

19. The apparatus of claim 18 wherein said adapter fitting comprises a coupling element extending through said opening and being threadably secured to said bag.

20. The apparatus of claim 18 wherein said adapter fitting comprises a coupling element extending through said opening and having a flange heat sealed to said bag.

21. The apparatus of claim 14 wherein said bag comprises a pair of sheets of laminate film material heat sealed together and having an adapter fitting assembled to an opening through one of said films.

22. The apparatus of claim 14 wherein said bag comprises a pair of sheets of laminate film material heat sealed together around the entire periphery of each sheet except for a relatively short length to provide said opening.

23. The apparatus of claim 22 wherein said connecting means comprises a self sealing valve of a laminate film material heat sealed to said bag film material at said opening.

24. The apparatus of claim 23 wherein said valve comprises a pair of sheets of laminate film material heat sealed together along opposite elongate edges to provide a passage between said edges for receiving an insertion tube.

25. The apparatus of claim 24 wherein each of said valve films is heat sealed to one each of said bag sheets at said opening.

26. The apparatus of claim 22 wherein said connecting means comprises an adapter fitting connected to a tube and said tube is maintained in said opening by a force fit connection.

27. The apparatus of claim 14 wherein said plastic bag, when empty, weighs less than 1 lb.

28. The apparatus of claim 14 wherein said bag comprises four sheets of laminate film material heat layered together and sealed about peripheral edges thereof to define an innermost interior space disposed between opposite outermost interior spaces and having an adapter fitting assembled to an opening through two of said films to provide an inlet to said innermost interior space.

29. A system for capturing refrigerant contained in a sealed, pressurized refrigeration system comprising:

an access valve for connection in a line of said refrigeration system;

a plastic bag made of laminate film material heat sealed together to define an interior space at atmospheric pressure, the film material being inert to the refrigerant, compressor oil and sealed system contaminants;

an access opening defined by said film material providing an inlet to said space;

a connection fitting secured to said bag at the access opening;

a flexible hose for connecting said fitting to said access valve to permit said refrigerant to escape under pressure from said refrigeration system to the interior space of said bag, said bag being adapted to maintain refrigerant in the interior space when the connecting means is removed and the interior space is again at atmospheric pressure: and means for sealing said opening to prevent captured refrigerant from escaping.

30. The system of claim 29 wherein said plastic bag is of a transparent material permitting inspection of the contents of the refrigerant captured in said bag.

31. The system of claim 29 further comprising a desiccant in the interior space of said plastic bag to remove moisture from the captured refrigerant.

32. The apparatus of claim 29 wherein said opening comprises an opening through said film material and said connection fitting comprises an adapter fitting secured to said film material at the opening for connecting to said refrigerant line.

33. The apparatus of claim 32 wherein said adapter fitting comprises a coupling element extending through said opening and being threadably secured to said bag.

34. The apparatus of claim 32 wherein said adapter fitting comprises a coupling element extending through said opening and having a flange heat sealed to said bag.

35. The apparatus of claim 29 wherein said bag comprises a pair of sheets of laminate film material heat sealed together and having an adapter fitting assembled to an opening through one of said films.

36. The apparatus of claim 29 wherein said bag comprises a pair of sheets of laminate film material heat sealed together around the entire periphery of each sheet except for a relatively short length to provide said opening.

37. The apparatus of claim 36 wherein said connecting means comprises a self sealing valve of a laminate film material heat sealed to said bag film material at said opening.

38. The apparatus of claim 37 wherein said valve comprises a pair of sheets of laminate film material heat sealed together along opposite elongate edges to provide a passage between said edges for receiving an insertion tube.

39. The apparatus of claim 38 wherein each of said valve sheets is heat sealed to one each of said bag sheets at said opening, 40. The apparatus of claim 36 wherein said connecting means comprises an adapter fitting connected to a tube and said tube is maintained in said opening by a force fit connection.

41. The apparatus of claim 29 wherein said bag comprises four sheets of laminate film material heat layered together and sealed about peripheral edges thereof to define an innermost interior space disposed between opposite outermost interior spaces and having an adapter fitting assembled to an opening through two of said films to provide an inlet to said innermost interior space.

42. The apparatus of claim 29 wherein said bag comprises a laminate film material having layers of linear low density polyethylene, adhesive and nylon.

43. The apparatus of claim 29 wherein said bag comprises a laminate film material having successive layers of linear low density polyethylene, adhesive, nylon, adhesive, and linear low density polyethylene.

44. A method of capturing refrigerant contained in a sealed, pressurized refrigeration system including a compressor having a high pressure side and a low pressure side, comprising the steps of:

attaching an access valve to the high pressure side of said compressor;

connecting a plastic bag to said access valve, said bag being at atmospheric pressure and of a material inert to the refrigerant and other contents of the sealed system;

opening said valve to permit said refrigerant to escape under pressure from said system to said bag wherein said compressor is operated as a pump to facilitate removal of the refrigerant from said refrigeration system, and subsequently closing said access valve; and removing said bag from said access valve.

* * * * *